US012644291B2

(12) United States Patent
Dai et al.

(10) Patent No.: US 12,644,291 B2
(45) Date of Patent: Jun. 2, 2026

(54) FLOORBOARD UNIT AND FLOORBOARD CONNECTING STRUCTURE

(71) Applicant: Zhejiang Kingdom New Material Group Co., Ltd., Jiaxing (CN)

(72) Inventors: Huibin Dai, Jiaxing (CN); Congkun Sheng, Jiaxing (CN); Zhiming Wang, Jiaxing (CN)

(73) Assignee: Zhejiang Kingdom New Material Group Co., Ltd., Jiaxing (CN)

( * ) Notice: Subject to any disclaimer, the term of this patent is extended or adjusted under 35 U.S.C. 154(b) by 233 days.

(21) Appl. No.: 18/487,696

(22) Filed: Oct. 16, 2023

(65) Prior Publication Data

US 2024/0392583 A1 Nov. 28, 2024

Related U.S. Application Data

(63) Continuation of application No. PCT/CN2023/104669, filed on Jun. 30, 2023.

(30) Foreign Application Priority Data

May 26, 2023 (CN) ..... 202310615849.9
May 26, 2023 (CN) ..... 202310620865.7

(51) Int. Cl.
*E04F 15/02* (2006.01)
*E04F 15/04* (2006.01)

(52) U.S. Cl.
CPC ..... *E04F 15/02044* (2013.01); *E04F 2015/0205* (2013.01); *E04F 15/04* (2013.01); *E04F 2201/023* (2013.01); *E04F 2201/043* (2013.01); *E04F 2201/0511* (2013.01)

(58) Field of Classification Search
CPC ..... E04F 15/00; E04F 15/02044; E04F 15/04; E04F 15/02; E04F 2015/0205; E04F 15/02022; E04F 15/02033; E04F 15/02038; E04F 15/02072; E04F 15/02077
See application file for complete search history.

(56) References Cited

U.S. PATENT DOCUMENTS 7,584,583 B2 * 9/2009 Bergelin ..... E04C 2/24 52/177
7,861,482 B2 * 1/2011 Pervan ..... E04F 15/02 52/177

(Continued)

*Primary Examiner* — Chi Q Nguyen
(74) *Attorney, Agent, or Firm* — Schwegman Lundberg & Woessner, P.A.

(57) ABSTRACT

A floorboard unit and a floorboard connecting structure are disclosed in the application. The floorboard unit includes a floorboard body and a connecting post. The connecting post is located at an end edge of a lower surface of the floorboard body, and an end of the connecting post is provided with a hooking part folded in a direction toward an end of the floorboard body, and the hooking part is of an approximate trapezoidal structure, and the hooking part is provided with an introduction sloping face for auxiliary clamping. The floorboard connecting structure according to the disclosure is of a locking type, so it can be paved without glue due to a locking force, which is safe and environment-friendly. A whole structure may extend all around with change of temperature, and there will be no problems such as uplift or cracking due to the change of temperature.

10 Claims, 8 Drawing Sheets

(56) References Cited

U.S. PATENT DOCUMENTS

| | | | | |
|---|---|---|---|---|
| 8,006,458 | B1 * | 8/2011 | Olofsson | E04F 15/02 52/489.1 |
| 8,336,272 | B2 * | 12/2012 | Prager | F16B 5/0044 52/592.1 |
| 11,725,394 | B2 * | 8/2023 | Pervan | E04F 15/102 52/586.1 |
| 2008/0104921 | A1 * | 5/2008 | Pervan | E04F 15/107 52/588.1 |
| 2010/0319291 | A1 * | 12/2010 | Pervan | E04F 15/02 52/745.21 |
| 2013/0263454 | A1 * | 10/2013 | Boo | E04C 2/38 29/897.32 |
| 2015/0000221 | A1 * | 1/2015 | Boo | E04F 15/02038 52/588.1 |
| 2015/0300029 | A1 * | 10/2015 | Pervan | E04F 15/02038 52/582.2 |
| 2021/0277668 | A1 * | 9/2021 | Vandenberg | E04F 15/02044 |
| 2024/0392581 | A1 * | 11/2024 | Dai | E04F 15/02038 |
| 2025/0116120 | A1 * | 4/2025 | Li | E04F 15/02038 |

* cited by examiner

FLOORBOARD UNIT AND FLOORBOARD CONNECTING STRUCTURE

TECHNICAL FIELD

The disclosure relates to the technical field of home improvement materials, in particular to a floorboard unit and a floorboard connecting structure.

BACKGROUND ART

At present, a floorboard, as one of main ways of floor decoration, is widely used in homes, offices, receptions and other places. A wooden floorboard has characteristics of comfortable feet feeling, natural texture and recyclable materials, but shortcomings of the wooden floorboard are poor humidity resistance and anti-aging ability. High humidity is easy to make wood swell, while drying may cause the wood to shrink, which then leads to bulging, warping and others.

There are many ways to connect planes of the floorboard, among which, a lock connection method is widely favored because it can reduce use of glue, can avoid glue and reduce indoor pollution. On the one hand, it is necessary to leave enough expansion and contraction space for thermal expansion and contraction, and on the other hand, an overall structure needs to be stable and reliable. However, the existing floorboard is complicated in structure and easy to be damaged during installation. However, for a floorboard with a simple structure, its splicing structure is not strong enough and there may be a problem of deformation after long-term use.

SUMMARY

In view of above problems, a floorboard unit and a floorboard connecting structure are provided in the disclosure, which are simple and table in structure and with a firm splicing structure.

Technical schemes adopted by the disclosure are as follows. A floorboard unit is provided in this disclosure, which includes a floorboard body and a connecting post. The connecting post is located at an end edge of a lower surface of the floorboard body, and an end of the connecting post is provided with a booking part folded in a direction toward an end of the floorboard body, and the hooking part is of an approximate trapezoidal structure, and the hooking part is provided with an introduction sloping face for auxiliary clamping. The approximate trapezoidal hooking part is simple and stable in structure, which enables the connecting post to have strength and to produce tension with a floorboard connecting base. The introduction sloping face can assist in smoothly pressing downward and install the floorboard unit to be clamped into the floorboard connecting base, so as to be closely connected with the floorboard connecting base. After the hooking part of the floorboard unit is pressed into the floorboard connecting base, the hooking part can be locked, and closely connected, with a step block of a base body.

Optionally, the hooking part is bent to form a first included angle β of 90° to 135°, which can ensure stability of a connecting structure between the floorboard connecting base and the floorboard unit, and also make assembly and disassembly of the floorboard unit smoother.

Optionally, the introduction sloping face is a plane or a convex arc face, so that the floorboard unit can be smoothly dropped into an installation groove of the floorboard connecting base when pressed.

Optionally, an edge of an upper surface of the floorboard body is provided with a first chamfer, and a second chamfer is provided at a first recess of the floorboard body, which can assist stress release, avoid a sharp structure, and do not hurt hands during disassembly. In addition, it can provide an expansion deformation space for thermal expansion and contraction.

Optionally, the end edge of the lower surface of the floorboard body is provided with a first groove, and the connecting post is located in the first groove to divide the first groove into a first recess and a second recess. The connecting post does not protrude from the floorboard body, which is not easy to be damaged and is also more beautiful. The connecting post is located in a middle of the first groove. The connecting post is not located in a right middle of the first groove, but anywhere between two ends of the first groove, as long as the connecting post can be accommodated in the first groove.

Optionally, a bottom of the second recess is smoothly transitioned with an arc. The arc at the bottom of the second recess of the floorboard unit contacts with a third convex arc part of the floorboard connecting base to achieve smooth transition effect.

Optionally, a first convex arc part is provided at a side of the connecting post proximate to the second recess, and the first convex arc part and the hooking part are distributed in an oblique diagonal structure. After the floorboard unit and the floorboard connecting base are locked, the hooking part of the floorboard unit and a step surface of the floorboard connecting base are locked with each other, and at the same time the first convex arc part abuts against the floorboard connecting base, so that the connecting post of the floorboard unit is more stable with the diagonal locking structure.

Optionally, a bottom of the first recess is provided with a fourth chamfer. The fourth chamfer can enhance stability of a part between the first chamfer and the second chamfer of the floorboard body.

A floorboard connecting structure is further provided in the disclosure, which includes a floorboard connecting base and the floorboard unit described above. The floorboard connecting base includes an installation groove for accommodating the connecting post and a step block for clamping and matching with the hooking part. When the connecting post of the floorboard unit is clamped into the installation groove of the floorboard connecting base, the hooking part of the floorboard unit and the step block are not easy to come off after locking and fastening each other because the step block enters the first recess of the floorboard unit.

Optionally, there are at least two joint surfaces between the connecting post and an inner wall of the installation groove, which are formed by closely matching planes and/or the arc faces, and two of the at least two joint surfaces are distributed in a relative structure or an oblique diagonal structure. The connecting post of the floorboard unit and the floorboard connecting base are locked by a diagonal structure, with a stable clamping structure.

Optionally, the floorboard connecting base is further provided with a seam filling part. The seam filling part is able to be flush with the upper surface of the floorboard unit, thereby achieving the purpose of filling a seam between two adjacent floorboard units.

Optionally, the floorboard connection structure further provides a floorboard connector having a transversal part and a longitudinal part, the transversal part and the longitudinal part are perpendicular to each other and cross, four curved parts are formed at the cross positions of the transversal part and the longitudinal part, and each of the curved part is provided with a first right-angle groove, and the first right-angle groove separates the floorboard connector to form a barrier wall and a first insertion block. The connecting post of the floorboard unit is inserted into the first right-angle groove of the floorboard connector, and the floorboard unit is provided with a second right-angle groove adapted to the first insertion block, i.e., and the first insertion block of the floorboard connector is inserted into the second right-angle groove of the floorboard unit, since the floorboard connector is a perpendicular cross-shape, it can assist four floorboard units to quickly find the position and be aligned, and the seams of four floorboard units are neater after paving, it can make the paving structure stable, and the floorboard unit is not easily shifted when in use.

The disclosure has following beneficial effects. The floorboard unit according to the disclosure includes the floorboard body and the connecting post, and the end of the connecting post is folded to form the hooking part, so that the structure is simple and stable. The hooking part of the approximate trapezoidal structure makes the connecting post have strength, and produce tension with a floorboard connecting base. After the hooking part of the floorboard unit is pressed into the floorboard connecting base, the hooking part can be locked, and closely connected, with a step block of a base body.

The floorboard connecting structure according to the disclosure is of a locking type, so it can be paved without glue due to a locking force, which is safe and environment-friendly and with tight joints. A whole structure may extend all around with change of temperature, and there will be no problems such as uplift or cracking due to the change of temperature, with good overall paving effect. For the floorboard connecting structure of the disclosure, a manual paving standard is replaced with an industrial standard, so that error of manual paving is reduced, and the floorboard can enter the groove by pressing or tapping the floorboard when paved, and its installation is simple.

Reference numbers are as follows: 1. Floorboard Connecting Base; 10. Base Body; 11. Convex Part; 12. Limiting Part; 13. Installation Groove; 14. Second groove; 15. Third chamfer; 16. First Concave Arc Part; 17. Seam Filling Part; 111. Third convex arc part; 112. Second Convex Arc Part; 121. Step Block; 122. U-shaped Groove; 123. Second Concave Arc Part; 121*a*. First Sloping Face; 121*b*. End of Step Block; 121*c*. Step Surface;

2. Floorboard Unit; 20. Floorboard Body; 21. Connecting Post; 22. First groove; 23. First chamfer; 24. Second Right-Angle Groove; 25. Second Insertion Block; 211. Hooking Part; 212. First convex arc part; 221. First Recess; 222. Second Recess; 21*l* a. Introduction Sloping Face; 221*a*. Second chamfer; 221*b*. Fourth Chamfer;

2*a*. First Floorboard Unit; 2*b*. Second Floorboard Unit;

3. Floorboard Connection Structure; 31. Horizontal Face; 32. First Arc Sloping Face; 33. Vertical Face; 34. Second Arc Sloping Face; 35. Floorboard Connector; 351. Transversal Part; 352. Longitudinal Part; 353. Curved part; 353*a*. First Right-Angle Groove; 353*b*. Barrier Wall; 353*c*. First Insertion Block; 353*d*. Right-Angle Cavity; 353*e*. Separating Groove;

α. Second included angle; β. First included angle.

DETAILED DESCRIPTION

In the following, a detailed and complete description of the present disclosure will be made in combination with specific embodiments with reference to the drawings.

Figure 1:
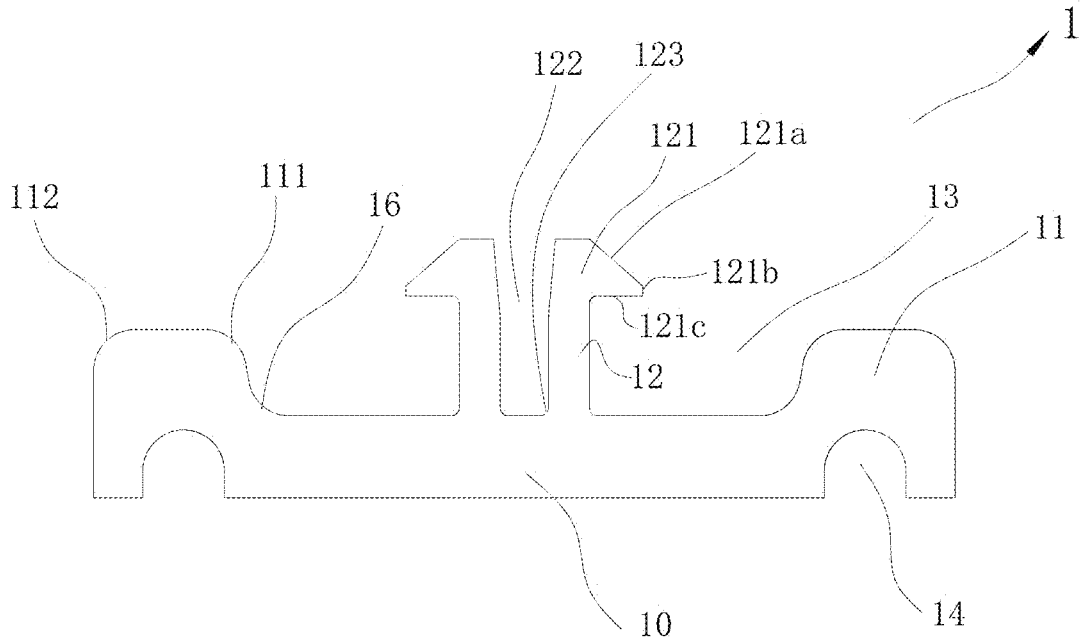
FIG. 1 is a schematic view of a floorboard connecting base according to an embodiment.
Figure 4:
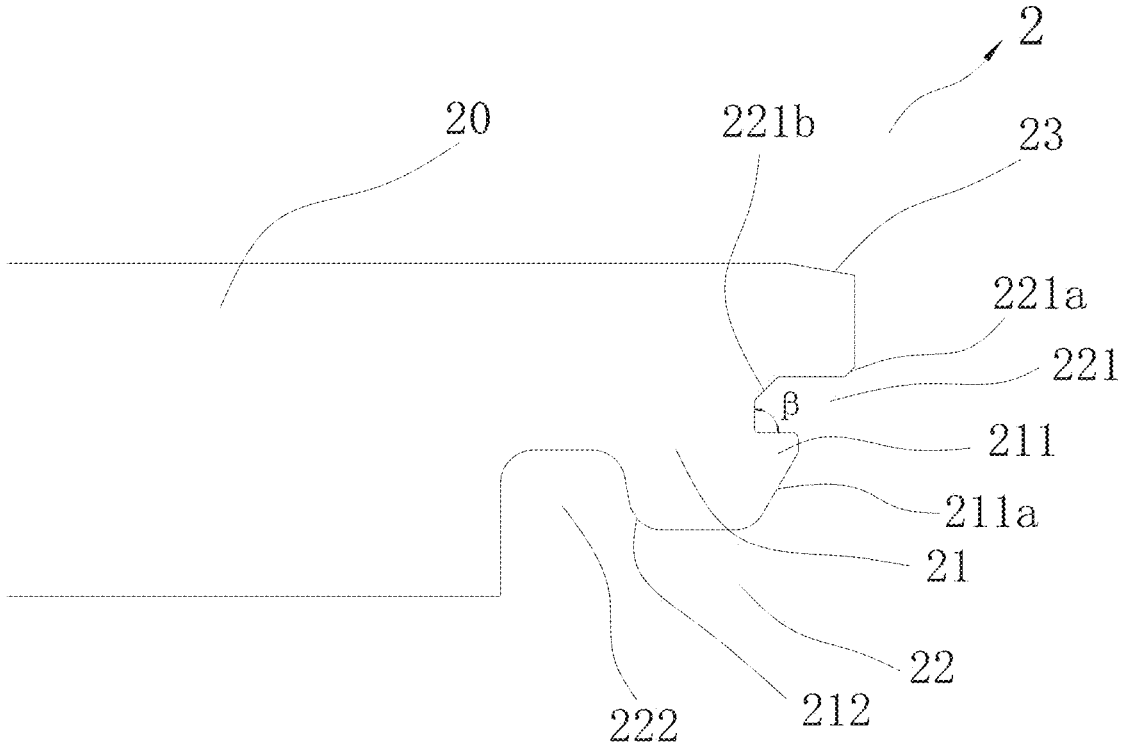
FIG. 4 is a schematic structural diagram of a floorboard unit according to an embodiment.

Referring to FIGS. 1 and 4, a floorboard connecting base 1 is provided in the present disclosure, which includes a base body 10, a convex part 11 and a limiting part 12. The convex part 11 and the limiting part 12 are located on an upper surface of the base body 10, and the convex part 11 and the limiting part 12 are arranged at intervals to form a mounting groove 13. When installed, a floorboard unit 2 is clamped into the mounting groove 13. A free end of the limiting part 12 is bent toward the convex part 11 to form a step block 121, which can form a semi-enclosed limiting structure for the inserted floorboard unit 2. The floorboard unit 2 can be stably matched, inserted and clamped with the floorboard connecting base 1, which is with a simple clamping structure and is suitable for diversity of floorboard paving and stable in structure.

Figure 8:
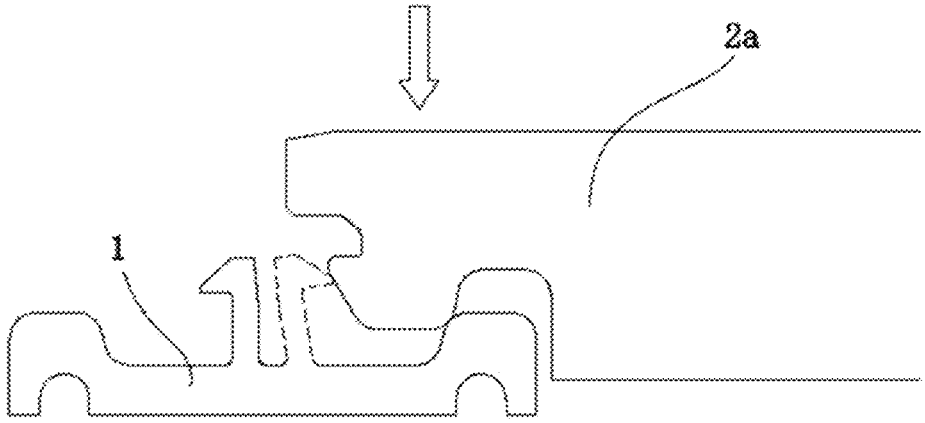
FIG. 8 is a schematic view of deformation of a step block and a convex part after being subjected to an expanding and extruding force when a first floorboard unit is pressed downward.
Figure 9:
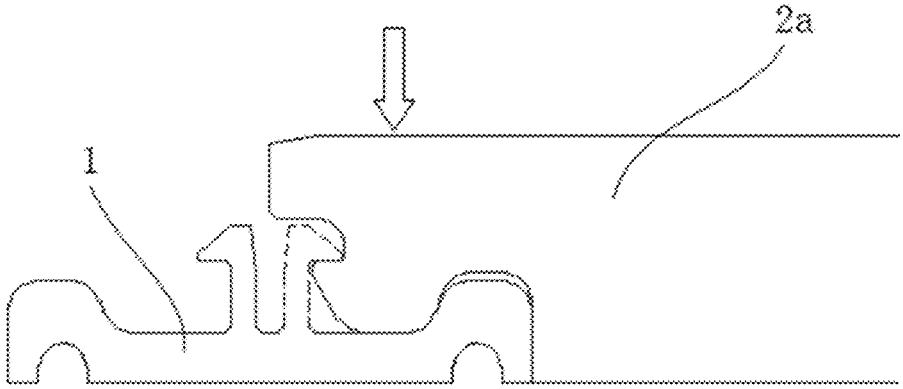
FIG. 9 is a schematic view of a step block being rebounded, hooked to a hooking part and tightly locked after the connecting post of the first floorboard unit is installed in the installation groove of the floorboard connecting base.
Figure 10:
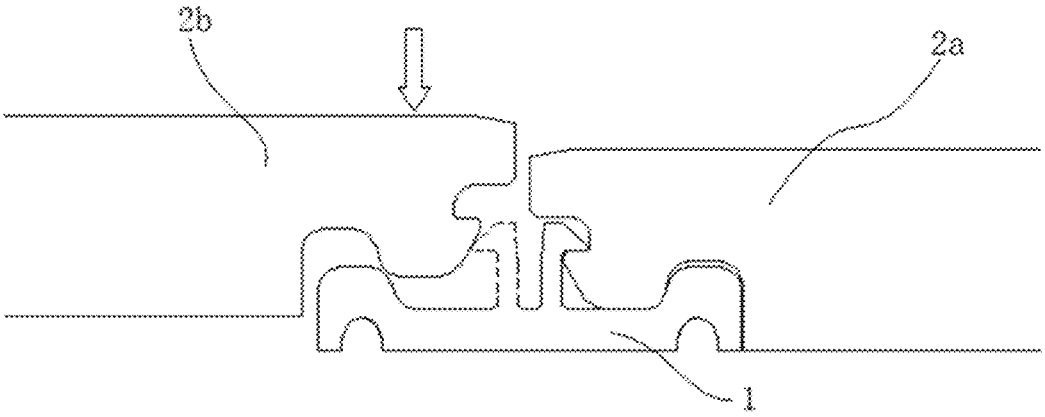
FIG. 10 is a schematic view of a step block and a convex part being subjected to an expanding and extruding force when a second floorboard unit is pressed downward.
Figure 11:
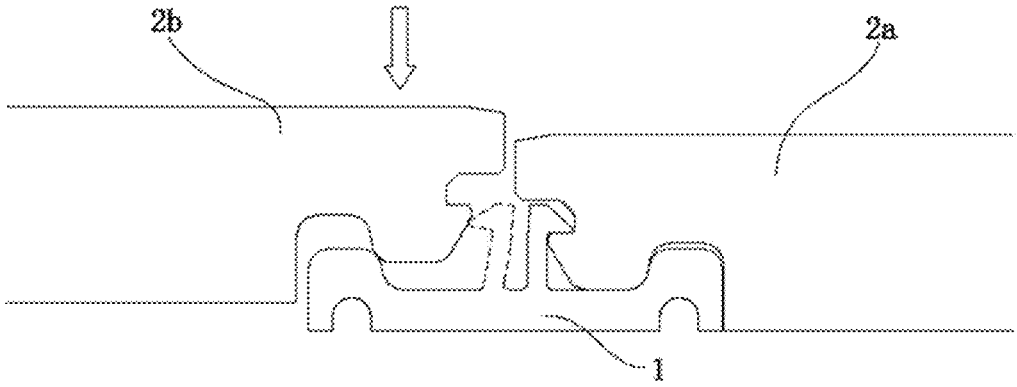
FIG. 11 is a schematic view of deformation of a step block and a convex part after being subjected to an expanding and extruding force when a second floorboard unit is pressed downward.
Figure 12:
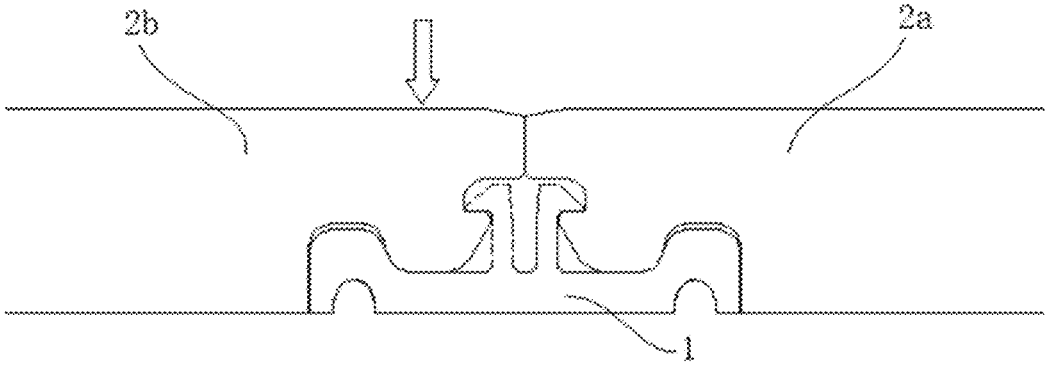
FIG. 12 is a schematic view of a step block being rebounded, hooked to a hooking part and tightly locked after the connecting post of the second floorboard unit is installed in the installation groove of the floorboard connecting base.

Referring to FIG. 1, in an embodiment, the base body 10 is provided with a second groove 14, and the second groove 14 is located below the convex part 11. Referring to FIG. 8 and FIG. 11, when the connecting post 21 of the floorboard unit 2 is dropped into the installation groove 13, the step block 121 and the convex part 11 can open to both sides. At this time, an elastic deformation space of the convex part 11 can be ensured when the second groove 14 is squeezed, which optimizes effect of pressing the floorboard unit 2 into the installation groove 13 and reduces use of materials.

A bottom of the second groove 14 is arc-shaped, which can evenly disperse a pressure, and at the same time, it can also disperse internal stress so as to prevent stress concentration, avoid uneven deformation of the floorboard connecting base 1 and damage due to material fatigue.

Figure 2:
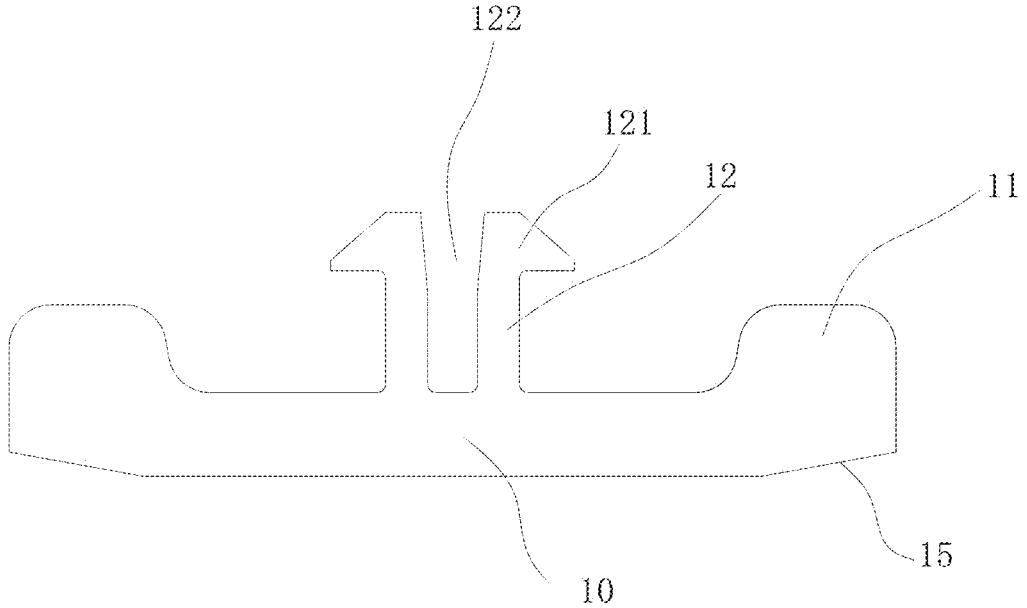
FIG. 2 is a schematic view of a floorboard connecting base according to another embodiment.

Referring to FIG. 2, in another embodiment, the base body 10 is provided with a third chamfer 15. A structure with the third chamfer 15 can achieve effect similar to that of the second groove 14. The third chamfer 15 is provided to cause a lower surface of the base body 10 to have a structure with a low middle part and two tilted ends, that is, an end of the lower surface of the base body 10 has a deformation space, which can also optimize effect of pressing products into the installation groove 13 and reduce the use of materials.

Referring to FIG. 1, a height of a step surface 121*c* of the step block 121 is not less than a height of the convex part 11. The limiting part 12 has good elasticity, and the connecting post 21 can smoothly enter the installation groove 13 during installation of the floorboard unit 2, and the limiting part can rebound in situ to lock the floorboard unit 2 when it is installed in place.

Referring to FIG. 1, the convex part 11 and the bottom of the installation groove 13 can be smoothly transitioned with a first concave arc part 16, so that the floorboard unit 2 can smoothly enter the installation groove 13. In addition, the first concave arc part 16 and the step surface of the step block 121 are distributed in an oblique diagonal structure. After the floorboard unit 2 and the floorboard connecting base 1 are locked, a hooking part 211 of the floorboard unit 2 and the step surface are locked with each other, and at the same time, the hooking part 211 abuts against the first concave arc part 16, so that the connecting post 21 of the floorboard unit 2 is more stable with a diagonal locking structure.

The number of the convex part 11 is two, the two convex parts 11 are located at the two ends of the upper surface of the base body 10, and the limiting part 12 is located between the two convex parts 11. The free end of the limiting part 12 is formed with two step blocks 121 bent in the direction of the two convex parts 11, respectively, so that two adjacent floorboard units 2 can be connected through the floorboard connecting base 1.

Referring to FIGS. 1 to 2, the limiting part 12 is provided with a U-shaped groove 122 in a vertical direction. When the connecting post 21 of the floorboard unit 2 is dropped into the installation groove 13, the step block 121 and the convex part 11 can open to both sides (as shown in FIGS. 8 and 11), and the U-shaped groove 122 can provide an elastic deformation space for the limiting part 12 when it is squeezed. A bottom of the U-shaped groove 122 is provided with a second concave arc part 123 which can increase structural stability and strength of the step block 121. A notch of the U-shaped groove 122 gradually expands outwards into a trumpet-shaped structure, which provides a larger deformation space for the step block 121.

When the floorboard unit 2 is installed, the connecting post 21 exerts a force on both the step block 121 and the convex part 1U, and the lack of the second groove 14 or the third chamfer 15, i.e., the convex part 11 lacks an elastic deformation space, the limiting part 12 is prone to excessive deformation leading to the failure of the locking type connection structure; and the lack of the U-shaped groove 122, i.e., the limiting part 12 lacks an elastic deformation space, the convex part 11 is similarly susceptible to excessive deformation leading to the failure of the locking type connection structure. Therefore, the U-shaped groove 122 of the limiting part 12 and the second groove 14/the third chamfer 15 of the convex part 11 make the limiting part 12 and the convex part 11 have excellent elastic deformation ability in the direction of force, which not only ensures that the limiting part 12 and the convex part 11 are not easy to be damaged, but also ensures that the floorboard unit 2 is smoothly pressed into the floorboard connecting base 1, and that the paving efficiency is high.

Figure 3:
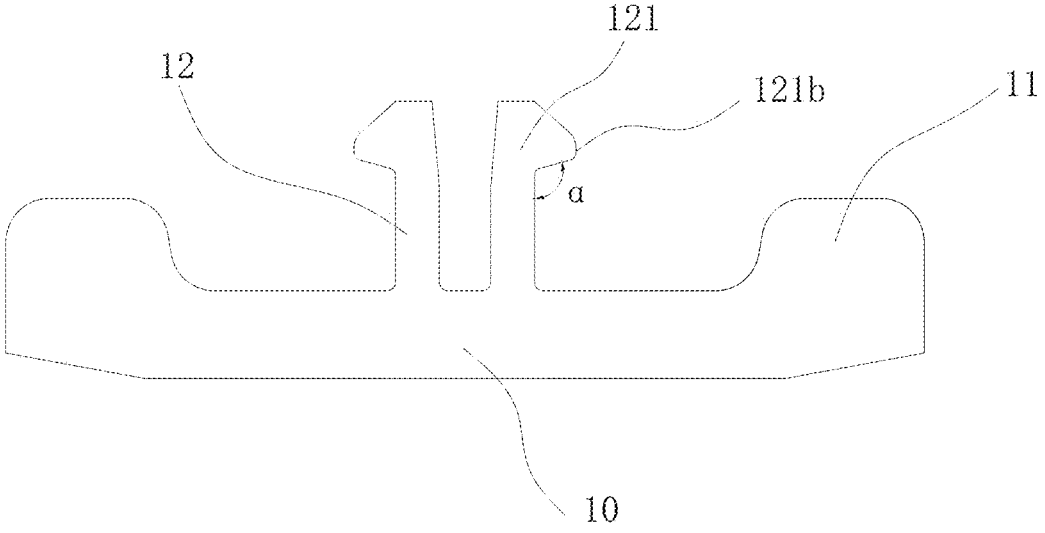
FIG. 3 is a schematic view of a floorboard connecting base according to yet another embodiment.

Referring to FIGS. 1 to 3, the step block 121 is of a stable triangular structure, and the step block 121 has a first sloping face 121*a*, and the first sloping face 121*a* is a plane or a convex arc face, so as to assist floorboard unit 2 in smoothly dropping into the installation groove 13 when pressed.

Referring to FIG. 3, a second included angle $\alpha$ between the step block 121 and the limiting part 12 is 90° to 135°, which can ensure stability of a connecting structure between the floorboard connecting base 1 and the floorboard unit 2, and also make assembly and disassembly of the floorboard unit 2 smoother. An end of the step block 121*b* is a convex circular arc, so a contact area between the floorboard unit 2 and the step block 121 is small, also with small friction resistance, which can also assist in smooth assembly and disassembly. If the second included angle $\alpha$ is less than 90°, and the floorboard unit 2 will be difficult to dismantle. If the second included angle $\alpha$ is greater than 135°, and the connection structure of the floorboard connecting base 1 and the floorboard unit 2 will be unstable.

Referring to FIG. 1, the convex part 11 is provided with a third convex arc part 111. When the floorboard unit 2 is installed and dropped into the floorboard connecting base 1, the third convex arc part 111 contacts the connecting post 21 of the floorboard unit 2, which can assist smooth entry into the installation groove 13. The convex part 11 is further provided with a second convex arc part 112, which can also assist the floorboard unit 2 in being smoothly clamped with the floorboard connecting base 1.

Figure 13:
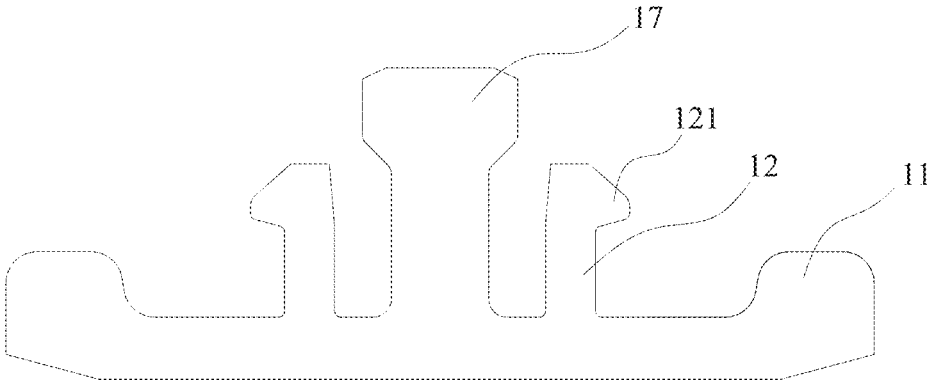
FIG. 13 is a schematic view of a floorboard connecting base according to still another embodiment.
Figure 14:
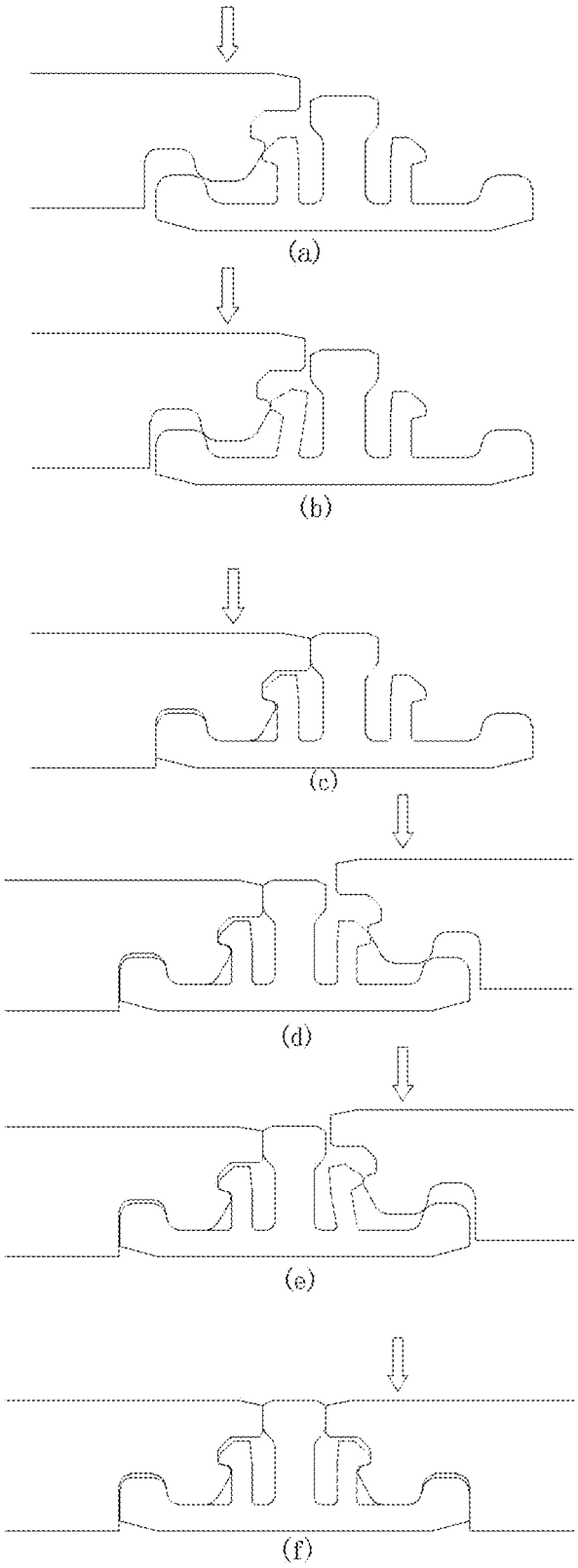
In FIG. 14, (a) (b) (c) (d) (e) (f) are schematic views of a floorboard unit pressed into the floorboard connecting base shown in FIG. 13.

Referring to FIG. 13 and (a) (b) (c) (d) (e) (1) in FIG. 14, the floorboard connecting base is further provided with a seam filling part 17. The seam filling part 17 is disposed in a columnar structure in a vertical direction within the u-shaped groove 122, and the height of the seam filling part 17 is higher than that of the limiting part 12, so that after the floorboard unit 2 is installed, the seam filling part 17 is able to be flush with the upper surface of the floorboard unit 2, thereby achieving the purpose of filling a seam between two adjacent floorboard units 2.

Referring to FIG. 4, a floorboard unit 2 is provided in this disclosure, which includes a floorboard body 20 and a connecting post 21. The connecting post 21 is located at an end edge of a lower surface of the floorboard body 20, and an end of the connecting post 21 is provided with a hooking part 211 folded in a direction toward an end of the floorboard body 20, and the hooking part 211 is of an approximate trapezoidal structure, and the hooking part 211 is provided with an introduction sloping face 211*a* for auxiliary clamping. The approximate trapezoidal hooking part 211 is simple and stable in structure, which enables the connecting post 21 to have strength and to produce tension with the floorboard connecting base 1. The introduction sloping face 211*a* can assist in smoothly pressing downward and install the floorboard unit 2 to be clamped into the floorboard connecting base 1, so as to be closely connected with the floorboard connecting base 1. After the hooking part 211 of the floorboard unit 2 is pressed into the floorboard connecting base 1, the hooking part 211 can be locked, and closely connected, with a step block 121 of a base body 10.

Referring to FIG. 4, the hooking part 211 is bent to form a first included angle β, and the first included angle β is 90° to 135°, which can ensure stability of a connecting structure between the floorboard connecting base 1 and the floorboard unit 2, and also make assembly and disassembly of the floorboard unit 2 smoother. If the first included angle β is less than 90°, and the floorboard unit 2 will be difficult to dismantle. If the first included angle β is greater than 135°, and the connection structure of the floorboard connecting base 1 and the floorboard unit 2 will be unstable.

Referring to FIG. 4, the introduction sloping face 211*a* is a plane or a convex arc face, so that the floorboard unit 2 can be smoothly dropped into an installation groove 13 of the floorboard connecting base 1 when pressed.

Optionally, an edge of an upper surface of the floorboard body 20 is provided with a first chamfer 23, and a second chamfer 221*a* is provided at a first recess 221 of the floorboard body 20, which can assist stress release, avoid a sharp structure, and do not hurt hands during disassembly. In addition, it can provide an expansion deformation space for thermal expansion and contraction.

Referring to FIG. 4, the end edge of the lower surface of the floorboard body 20 is provided with a first groove 22, and the connecting post 21 is located in the first groove 22 to divide the first groove 22 into a first recess 221 and a second recess 222. The connecting post 21 does not protrude from the floorboard body 20, which is not easy to be damaged and is also more beautiful. A bottom of the second recess 222 is smoothly transitioned with an arc, and contacts with the floorboard connecting base 1 to achieve smooth transition effect.

Referring to FIG. 4, a first convex arc part 212 is provided at a side of the connecting post 21 proximate to the second recess 222, and the first convex arc part 212 and the hooking part 211 are distributed in an oblique diagonal structure. After the floorboard unit 2 and the floorboard connecting base 1 are locked, the hooking part 211 of the floorboard unit 2 and a step surface of the floorboard connecting base 1 are locked with each other, and at the same time the first convex arc part 212 abuts against the floorboard connecting base 1, so that the connecting post 21 of the floorboard unit 2 is more stable with the diagonal locking structure.

Referring to FIG. 4, a bottom of the first recess 221 is provided with a fourth chamfer 221*b*. The fourth chamfer 221*b* can enhance stability of a part between the first chamfer 23 and the second chamfer 221*a* of the floorboard body 20.

Figure 5:
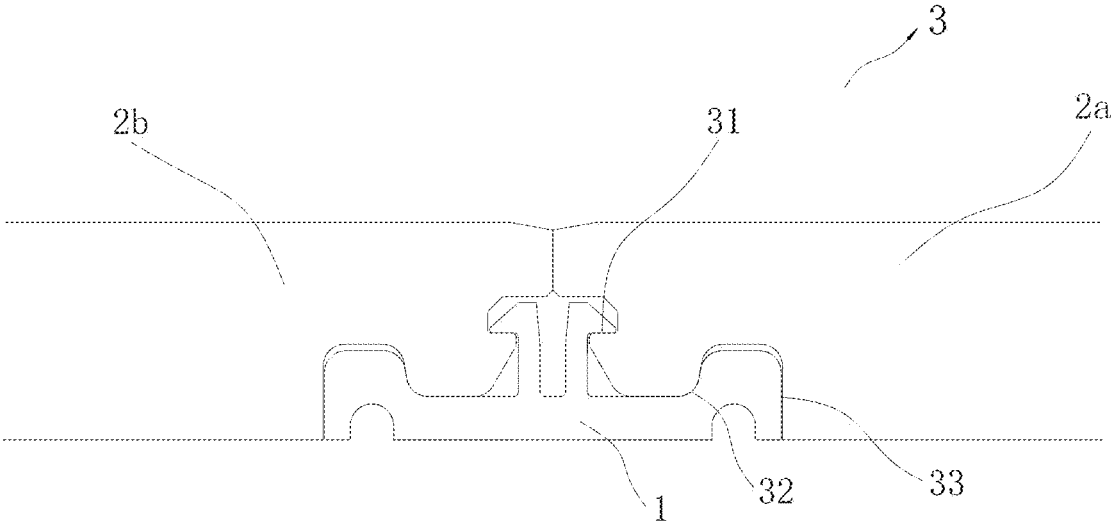
FIG. 5 is a schematic view of a structure of a floorboard connecting base according to an embodiment.
Figure 6:
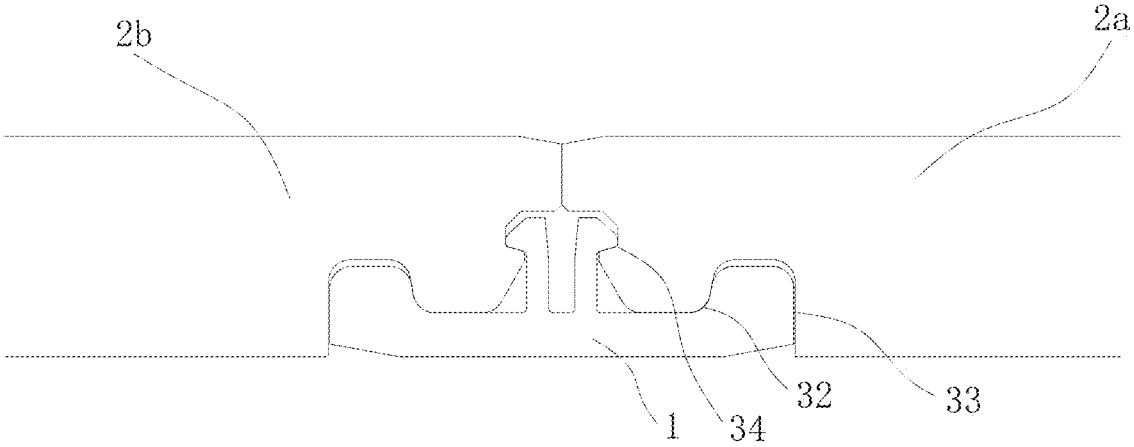
FIG. 6 is a schematic view of a structure of a floorboard connecting base according to another embodiment.
Figure 7:
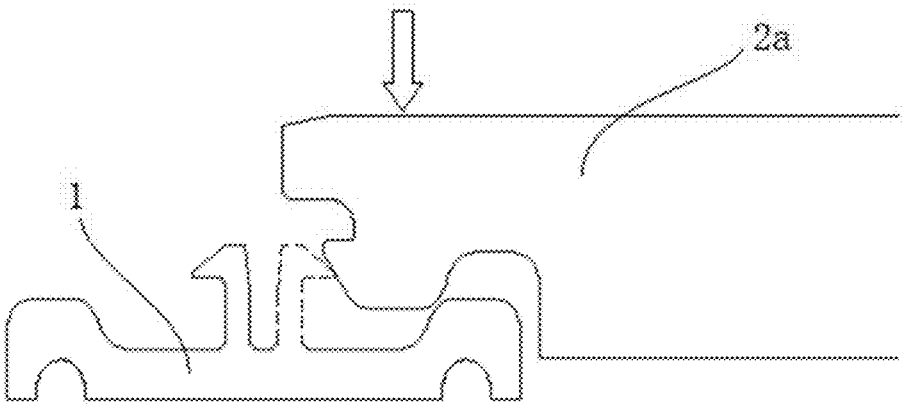
FIG. 7 is a schematic view of a step block and a convex part being subjected to an expanding and extruding force when a first floorboard unit is pressed downward.

Referring to FIGS. 5 to 6, a floorboard connection structure 3 is further provided in the present disclosure, in which two adjacent floorboard units 2 (a first floorboard unit 2*a* and a second floorboard unit 2*b*) are connected through the floorboard connecting base 1. The connecting post 21 of the floorboard unit 2 is clamped into the installation groove 13, and the hooking part 211 of the connecting post 21 is engaged and matched with the step block 121 of the floorboard connecting base 1. The hooking part 211 of the floorboard unit 2 and the step block 121 are not easy to come off after locking and fastening each other, since the step block 121 of the floorboard connecting base 1 enters the first recess 221 of the floorboard unit 2. A specific installation process of the first floorboard unit 2*a* and the second floorboard unit 2*b* is shown in FIGS. 7 to 12. Wherein, the convex part 11 may act as a restriction for the first floorboard unit 2*a* and the second floorboard unit 2*b* in the horizontal direction.

Referring to FIGS. 5 to 6, there are at least two joint surfaces between the connecting post 21 and an inner wall of the installation groove 13, which are formed by closely matching planes and/or arc faces, and two of the at least two joint surfaces are distributed in a relative structure or an oblique diagonal structure. The connecting post 21 of the floorboard unit 2 and the floorboard connecting base 1 are locked by a diagonal structure, with a stable clamping structure.

Referring to FIG. 5, in an embodiment, two of the at least two joint surfaces are a horizontal face 31 and a first arc sloping face 32 distributed in an oblique diagonal structure, and a vertical face 33 is further included between the floorboard unit 2 and the floorboard connecting base 1. Specifically, the horizontal plane 31 is formed by abutting of the step surface 121*a* of the step block 121 and the hooking part 211, and the first arc sloping face 32 is formed by abutting of the first concave arc part 16 of the floorboard connecting base 1 and the first convex arc part 212 of the floorboard unit 2. The first arc sloping face 32 has horizontal and vertical directions, which are opposite to the horizontal face 31 and the vertical face 33 respectively, and the limiting structure is stable.

Referring to FIG. 6, in an embodiment, two of the at least two joint surfaces are a first arc sloping face 32 and a second arc sloping face 34 distributed in an oblique diagonal structure, and a vertical face 33 is further included between the floorboard unit 2 and the floorboard connecting base 1. Specifically, the first arc sloping face 32 is formed by abutting of the first concave arc part 16 of the floorboard connecting base 1 and the first convex arc part 212 of the floorboard unit 2, and the second arc sloping face 34 is formed by abutting of the step block 121 and the hooking part 211. Both the first arc sloping face 32 and the second arc sloping face 34 have horizontal and vertical directions, and in combination with the vertical surface 33 for assisting in clamping, the limiting structure is stable.

Referring to FIGS. 1, 4 and 5, a slope of the introduction sloping face 211*a* is greater than that of a sloping face of the step block 121. When the booking part 211 is pressed into the installation groove 13, it can contact with the sloping face of the step block 121. When the slope of the introduction sloping face 211*a* is larger than that of the sloping face of the step block 121, a contact area between the step block 121 and the hooking part 211 can be reduced, thereby reducing friction effect, reducing elastic deformation of the limiting part 12 and avoiding structural failure of the limiting part 12 due to excessive deformation. In addition, after the hooking part 211 is clamped, it cooperates with the limiting part 12 to form a triangular gap, with a stable structure.

Figure 18:
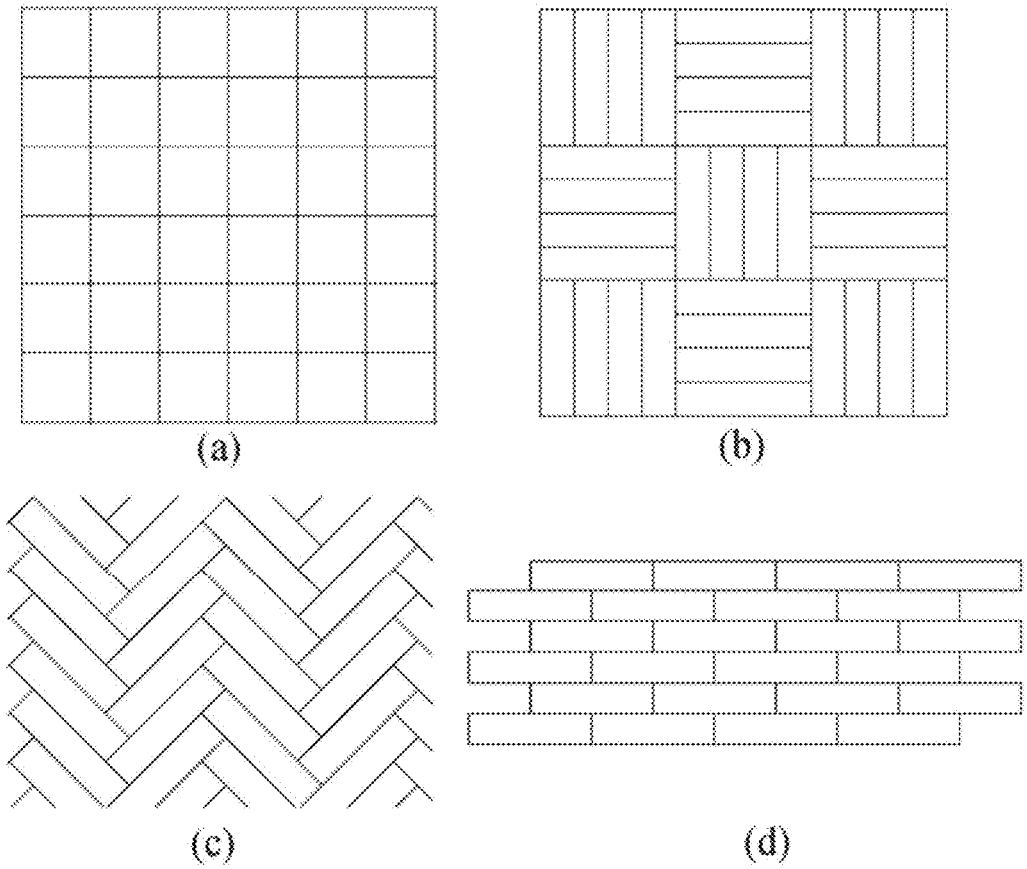

Referring to (a) (b) (c) (d) shown in FIG. 18, various splicing structures can be constituted by the floorboard connecting base 1 and the floorboard unit 2 in the present disclosure. In addition, compared to the existing method of connecting by separately providing male buckles and female buckles on adjacent floorboard units, the floorboard unit 2 in the present disclosure has a consistent groove structure, which facilitates manufacturing.

Figure 15:
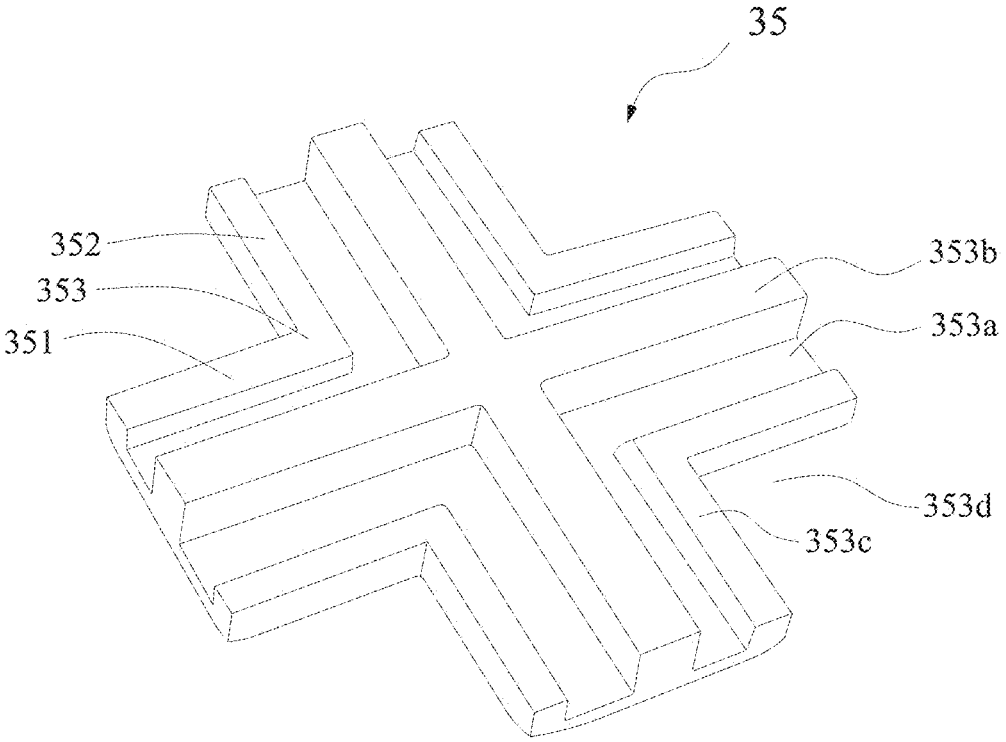
FIG. 15 is a schematic view of a floorboard connector according to an embodiment.
Figure 16:
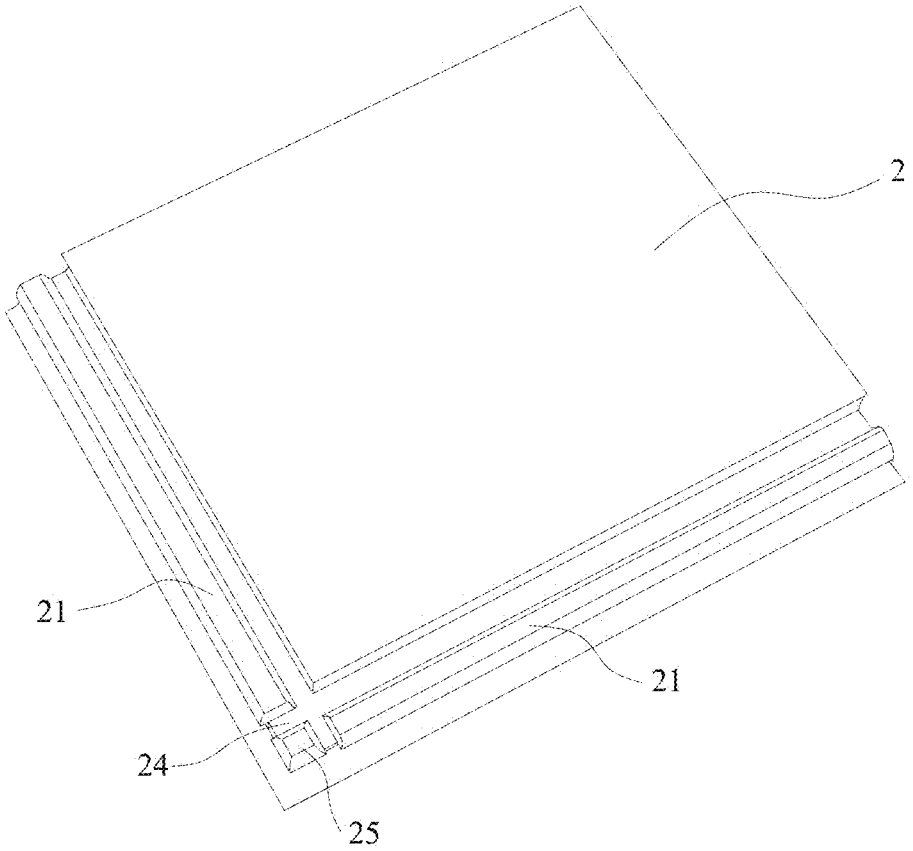
FIG. 16 is a schematic view of a lower surface of a floorboard unit according to an embodiment.

Referring to FIG. 15, the floorboard connection structure 3 further provides a floorboard connector 35 having a transversal part 351 and a longitudinal part 352. The transversal part 351 and the longitudinal part 352 are perpendicular to each other and cross. Four curved parts 353 are formed at the cross positions of the transversal part 351 and the longitudinal part 352, and each of the curved part 353 is provided with a first right-angle groove 353*a*, and the first right-angle groove 353*a* separates the floorboard connector 35 to form a barrier wall 353*b* located at a middle portion and four first insertion blocks 353*c* of the right-angled structure. Referring to FIG. 16, it is shown that the floorboard unit 2 is rectangular, with a second right-angle groove 24 and a second insertion block 25 provided at least one right angle of the rectangle. Each curved part 353 is used for the insertion of one floorboard unit 2.

Specifically, when the floorboard connector 35 is spliced with the floorboard unit 2, the connecting post 21 of the floorboard unit 2 is inserted into the first right-angle groove 353*a* of the floorboard connector 35, respectively, and the first insertion block 353*c* of the floorboard connector 35 is inserted into the second right-angle groove 24 of the floorboard unit 2, while the second insertion block 25 of the floorboard unit 2 falls into a right-angle cavity 353*d*. Since the floorboard connector 35 is a perpendicular cross-shape, it can assist four floorboard units 2 to quickly find the position and be aligned, and the seams of four floorboard units 2 are neater after paving, it can make the paving structure stable, and the floorboard unit 2 is not easily shifted when in use.

Wherein the height of the barrier wall 353*b* is greater than the height of the first insertion block 353*c*. The first insertion block 353*c* is shorter, which facilitates the insertion of the floorboard unit 2 into the floorboard connector 35, and the barrier wall 353*b* is higher which facilitates the restriction of the floorboard unit 2.

Figure 17:
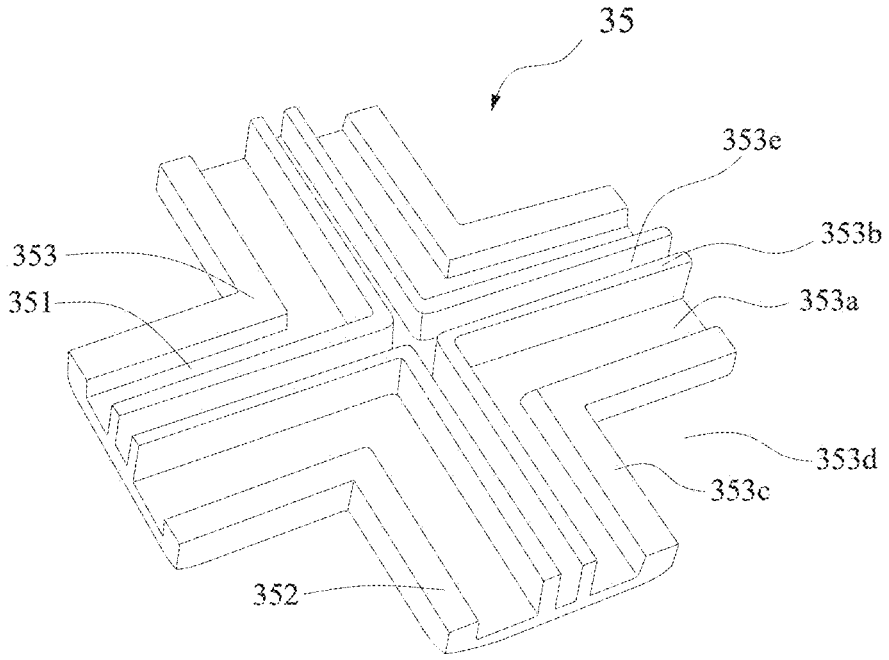
FIG. 17 is a schematic view of a floorboard connector according to another embodiment; and In FIG. 18, (a) (b) (c) (d) are schematic views of a plurality of floorboard connecting bases and a plurality of floorboard units constituting various splicing structures.

The upper surface of the barrier wall 353*b* may be flat surface or convex curved surface. Referring to FIG. 17, the middle of the barrier wall 353*b* is provided with a separating groove 353*e* along its length, which also reduces the use of materials while ensuring the structural soundness of the floorboard connector 35 and assisting in the quick alignment of the floorboard unit 2.

The above is only preferred embodiments of the present disclosure, which does not limit a protection scope of the present disclosure. Any equivalent transformation made with the specification of the present disclosure, which is directly or indirectly applied to other related technical fields, is included within the scope of the disclosure.

What is claimed is:

1. A floorboard connecting structure, comprising a floorboard connecting base and a floorboard unit, the floorboard unit comprising:

a floorboard body;

a connecting post located at an end edge of a lower surface of the floorboard body, an end of the connecting post being provided with a hooking part folded in a direction toward an end of the floorboard body, and the hooking part being of a trapezoidal structure, and the hooking part being provided with an introduction sloping face for auxiliary clamping:

wherein the floorboard connecting base comprises an installation groove for accommodating the connecting post and a step block for clamping and matching with the hooking part;

wherein the floorboard connection structure further provides a floorboard connector having a transversal part and a longitudinal part, the transversal part and the longitudinal part are perpendicular to each other and cross, four curved parts are formed at the cross positions of the transversal part and the longitudinal part and each of the curved part is provided with a first right-angle groove, and the first right-angle groove separates the floorboard connector to form a barrier wall and a first insertion block;

wherein the connecting post of the floorboard unit is inserted into the first right-angle groove, and the floorboard unit is provided with a second right-angle groove adapted to the first insertion block.

2. The floorboard connecting structure according to claim 1, wherein there are at least two joint surfaces between the connecting post and an inner wall of the installation groove, at least two joint surfaces are formed by closely matching planes and/or arc faces, and two of the at least two joint surfaces are distributed in a relative structure or an oblique diagonal structure.

3. The floorboard connecting structure according to claim 1, wherein the floorboard connecting base is further provided with a seam filling part.

4. The floorboard connecting structure according to claim 1, wherein the hooking part is bent to form a first included angle $\beta$ of 90° to 135°.

5. The floorboard connecting structure according to claim 1, wherein the introduction sloping face is a plane or a convex arc face.

6. The floorboard connecting structure according to claim 1, wherein an upper surface of the floorboard body is provided with a first chamfer, and a second chamfer is provided at a first recess of the floorboard body.

7. The floorboard connecting structure according to claim 1, wherein the end edge of the lower surface of the floorboard body is provided with a first groove, and the connecting post is located in the first groove to divide the first groove into a first recess and a second recess.

8. The floorboard unit according to claim 7, wherein a bottom of the second recess is smoothly transitioned with an arc.

9. The floorboard unit according to claim 7, wherein a first convex arc part is provided at a side of the connecting post proximate to the second recess, and the first convex arc part and the hooking part are distributed in an oblique diagonal structure.

10. The floorboard unit according to claim 7, wherein a bottom of the first recess is provided with a fourth chamfer.

* * * * *